US008007201B2

(12) United States Patent
Currivan

(10) Patent No.: US 8,007,201 B2
(45) **Date of Patent: *Aug. 30, 2011**

(54) SEPTIC SYSTEM

(76) Inventor: Frank Currivan, Riverside, CT (US)

( * ) Notice: Subject to any disclaimer, the term of this patent is extended or adjusted under 35 U.S.C. 154(b) by 74 days.

This patent is subject to a terminal disclaimer.

(21) Appl. No.: 12/291,096

(22) Filed: Nov. 6, 2008

(65) Prior Publication Data

US 2009/0067928 A1 Mar. 12, 2009

Related U.S. Application Data

(63) Continuation-in-part of application No. 11/894,934, filed on Aug. 22, 2007, now abandoned, and a continuation-in-part of application No. 11/523,486, filed on Sep. 19, 2006, now abandoned, which is a continuation-in-part of application No. 11/235,405, filed on Sep. 26, 2005, now Pat. No. 7,384,212.

(51) Int. Cl.
*E02B 11/00* (2006.01)
*E02B 13/00* (2006.01)

(52) U.S. Cl. ..... 405/43; 405/45; 405/46; 405/49

(58) Field of Classification Search ..... 405/43–49, 405/52, 53, 36

See application file for complete search history.

(56) References Cited

U.S. PATENT DOCUMENTS

| | | | | |
|---|---|---|---|---|
| 3,220,194 | A | 11/1965 | Lienard | 405/45 |
| 3,401,526 | A | 9/1968 | Rodgers, III | 405/45 |
| 3,645,100 | A | 2/1972 | La Monica | 405/46 |
| 3,820,341 | A | 6/1974 | Richard et al. | 405/46 |
| 4,145,157 | A | 3/1979 | Lascelles | 405/43 |
| 4,192,628 | A | 3/1980 | Gorman | 405/45 |
| 4,588,325 | A | 5/1986 | Seefest | 405/46 |
| 4,759,661 | A | 7/1988 | Nichols et al. | 405/48 |
| 4,824,287 | A | 4/1989 | Tracy | 405/36 |
| 5,015,123 | A | 5/1991 | Houck et al. | 405/45 |
| 5,401,116 | A | 3/1995 | Nichols | 405/48 |
| 5,441,363 | A | 8/1995 | Gray | 405/49 |
| 5,498,104 | A | 3/1996 | Gray | 405/43 |
| 5,511,903 | A | 4/1996 | Nichols et al. | 405/43 |
| 5,556,231 | A | 9/1996 | Sidaway et al. | 405/48 |
| 5,588,778 | A | 12/1996 | Nichols et al. | 405/48 |
| 5,810,509 | A | 9/1998 | Nahlik, Jr. | 405/43 |
| 5,890,837 | A | 4/1999 | Wells | 405/43 |
| 5,890,838 | A | 4/1999 | Moore, Jr. et al. | 405/49 |
| 5,921,711 | A * | 7/1999 | Sipaila | 405/45 |
| 5,954,451 | A * | 9/1999 | Presby | 405/49 |
| 6,076,993 | A | 6/2000 | Gray | 405/43 |
| 6,267,882 | B1 | 7/2001 | Houck et al. | 405/43 |
| 6,312,248 | B2 | 11/2001 | Goughnour | 405/36 |
| 6,361,248 | B1 | 3/2002 | Maestro | 405/49 |
| 6,443,652 | B1 | 9/2002 | Houck et al. | 405/46 |
| 6,612,777 | B2 | 9/2003 | Maestro | 405/49 |
| 6,679,653 | B1 | 1/2004 | DiTullio | 405/49 |
| 6,854,925 | B2 | 2/2005 | DiTullio | 405/49 |

(Continued)

*Primary Examiner* — Frederick L Lagman

(74) *Attorney, Agent, or Firm* — Ohlandt, Greeley, Ruggiero & Perle, LLP

(57) ABSTRACT

A modular or integral appendage for a septic collection housing having a first section for connected to a lateral side of the housing with the first section having a number of apertures thereon. The first section has a first area. The lateral side of the housing has a second area. The first area is greater than the second area for increased drainage and thus adds capacity to the housing. The second area having a plurality of protuberances thereon.

40 Claims, 15 Drawing Sheets

U.S. PATENT DOCUMENTS

| | | | | |
|---|---|---|---|---|
| 7,374,670 | B2 | 5/2008 | Potts | 210/150 |
| 7,384,212 | B2 * | 6/2008 | Currivan | 405/43 |
| 2004/0253054 | A1 * | 12/2004 | Atchley | 405/43 |
| 2005/0269253 | A1 * | 12/2005 | Potts | 210/150 |
| 2006/0182497 | A1 | 8/2006 | Potts | 405/46 |
| 2006/0272988 | A1 | 12/2006 | Potts | 210/170.01 |

* cited by examiner

SEPTIC SYSTEM

CROSS-REFERENCE TO RELATED APPLICATIONS

This application is a continuation-in-part of U.S. application Ser. No. 11/894,934, filed on Aug. 22, 2007, now abandoned and is a continuation-in-part of U.S. application Ser. No. 11/523,486 filed on Sep. 19, 2006, now abandoned which is also a continuation-in-part Ser. No. 11/235,405 filed on Sep. 26, 2005, now U.S. Pat. No. 7,384,212.

BACKGROUND OF THE INVENTION

1. Field of the Invention

The present invention relates to a septic system for handling household waste water. More particularly, the present invention relates to a septic system that can expand the amount of filtering material around or adjacent to a conventional new, existing septic gallery, or provide a new unitary gallery or unitary system to expand a septic system capacity. Yet, still more particularly, the present invention relates to a septic system having effluent chambers and modular conduits having appendages for dispersing fluid in a leach field to expand a septic system capacity.

2. Description of the Related Art

Septic systems are well known in the art. One such septic system is disclosed in U.S. Pat. No. 4,759,661 to Nichols, et al. (hereinafter "Nichols"). Nichols discloses a leaching system conduit made from a thermoplastic member having lateral sidewalls with a number of apertures. The thermoplastic member is an arch shaped member in cross section and has the apertures for the passage of liquid therethrough. The lateral sidewalls also have a number of corrugations formed in a rectangular shaped manner.

Such septic systems are deficient in their operation. First of all, zoning ordinances for certain sized homes require larger septic systems. Such larger septic systems may not fit on the desired building lot. A large number of bedrooms in a new home construction require according to some zoning laws that a certain sized septic system be used or that the certain sized septic system have a predetermined volume. This can be problematic under certain circumstances because the desired septic system may not fit in a certain lot and the new home owner may be limited to only a second sized septic system that is less than desired. With this smaller septic system, the new home builder thus must reduced the size of the new home. Secondly, in other circumstances homeowners may wish to expand the capacity of the septic system in a retrofit manner from a first size to another second size to accommodate a larger home.

However, a known problem in the art is that under this arrangement, the second sized larger septic system like Nichols' leaching system will require the homeowner to excavate the leaching system and remove the leaching system. Thereafter, the homeowner will have to remove additional soil and dirt and then insert a new second sized larger septic system. Thereafter, the homeowner may have to perform additional work to the home to accommodate the home with this replacement and further obtain all of the requisite permits and variances to the zoning laws.

Accordingly, there is a need for a septic system that increases an amount of filtering medium so smaller septic systems may be used with larger homes thus maintaining an amount of effluent entering the septic system. There is also a need for a septic system that does not require replacement of the entire septic system for an upgrade. There is also a need for a septic system that has a more productive filtering. There is a further need for a septic system that has an attachment that can expand a complementary filtering area of the septic system with modular components. There is a further need for a septic system that is entirely unitary and has a smaller foot print.

There is also a need for such a system that eliminates one or more of the aforementioned drawbacks and deficiencies of the prior art.

SUMMARY OF THE INVENTION

The present disclosure provides for a septic system for a residential home or commercial building.

The present disclosure also provides for a septic system that can be connected in a modular fashion to an existing septic system.

The present disclosure further provides for a septic system that increases a surface area on a lateral side of an existing septic system.

The present disclosure yet further provides for a septic system that includes a device that adds capacity to an existing septic system.

The present disclosure still yet further provides for a septic system that has a large capacity in a smaller footprint or space underneath ground.

The present disclosure further yet still further provides for a septic that has a baffling arrangement on a lateral side for an improved interface with ground.

The present disclosure further provides for a septic system that has a triangular baffling arrangement on a lateral side of an existing system for an improved interface with sand.

The present disclosure further provides for a septic system that has a triangular or trapezoidal baffling arrangement on a lateral side of an existing system for an improved interface with sand.

The present disclosure further provides for a septic system that has a triangular or trapezoidal baffle arrangement having protuberances on the surface thereof.

The present disclosure further provides for a septic system that is a unitary septic system having either a triangular, trapezoidal or shaped baffling arrangement on opposite sides of a narrow pipe or a rectangular gallery.

The present disclosure further provides for a septic system that has a rectangular baffle arrangement arrangement having protuberances on the surface thereof.

The present disclosure further provides for a septic system that is a unitary septic system having a plurality of rectangular shaped members in the baffling arrangement on opposite sides of a narrow pipe or a rectangular gallery.

The present disclosure further provides for a septic system that is a unitary septic system having a plurality of rectangular shaped members in the baffling arrangement on opposite sides of a narrow pipe or a rectangular gallery in which the rectangular shaped members each have a modular configuration for ease of assembly.

The present disclosure further provides for a septic system that is a unitary septic system having either a plurality of rectangularly shaped members disposed on opposite sides of an effluent chamber or modular conduit.

These and other objects and advantages of the present disclosure are achieved by a septic system of the present disclosure. The system has a modular appendage for a septic gallery and the appendage has a first modular section for connection to a lateral side of the effluent chamber or modular conduit with the first modular section having a apertures thereon.

DETAILED DESCRIPTION OF THE INVENTION

Figure 1:
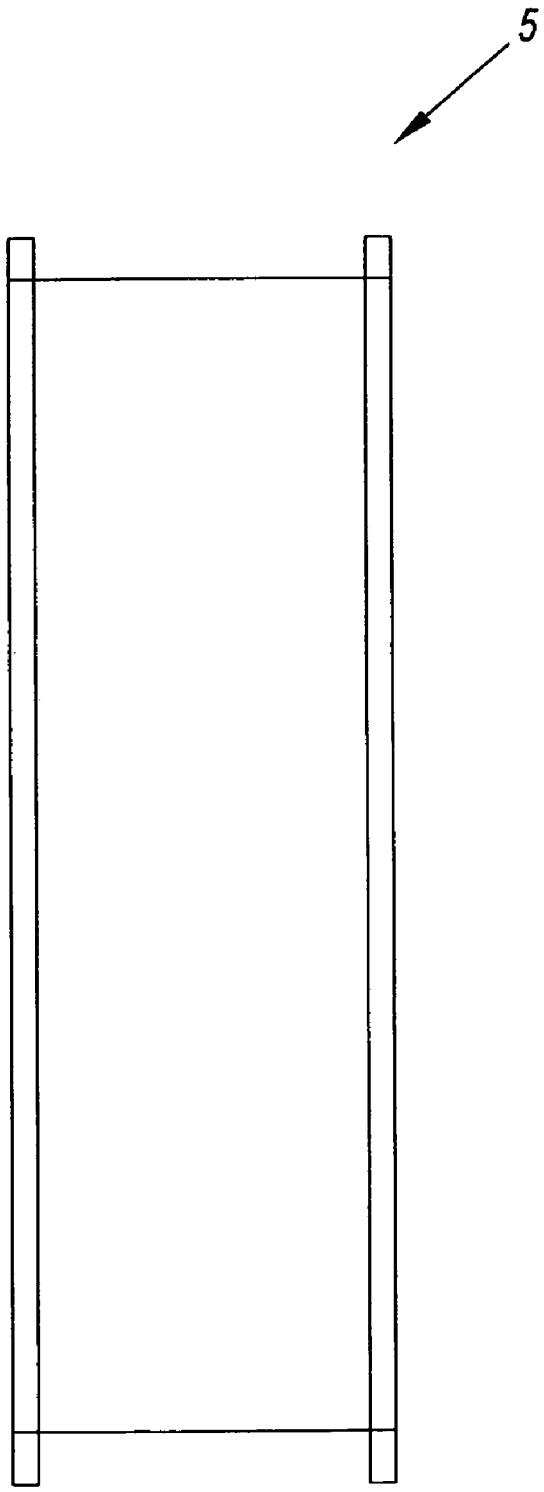
Fig. 1 (Prior Art)
FIG. 1 illustrates a prior art septic gallery.

Referring to FIG. 1, there is shown a septic gallery 5 as is known in the art. The septic gallery 5 is preferably a container that is placed in a leaching field, such as ground or sand, and is utilized for drainage of effluent. Effluent is a term commonly used for waste materials such as liquid and solid industrial refuse or liquid and solid residential sewage that flows out of a source and is discharged into the environment. The effluent is carried from a source such as a bathroom to the septic tank, then to the leaching field for dispersion, diffusion, or percolation, into surrounding soil.

Known pipes carry the effluent discharge and release the material into a chamber, or vault such as the septic gallery 5. The gallery 5 as is known will have a number of perforation or holes leading from the septic gallery 5. The gallery 5 is usually buried in a trench to facilitate dispersion of the effluent into the soil. All of the solid effluent stays in the septic tank, and only the liquid and liquid effluent diffuses into the sand.

In some systems, the gallery 5 is defined by a large diameter perforated conduit. In other systems, the gallery 5 is perforated to provide direct dispersion into the sand. The effluent is then dispersed into the soil either through the soil serving as the floor of the gallery 5 or, when effluent accumulates in the gallery, through passages in side walls thereof.

One known problem in the art is that the interface between the gallery 5 and the ground only allows for a finite flow or dispersion rate of liquid waste from the gallery to the soil or sand on the other side. The inventor of the present invention has recognized this known problem and has solved the problem with the present invention that has a number of unexpected benefits that increase a capacity for liquid waste of the gallery 5, and allows an increased amount of liquid and liquid waste to diffuse into the ground.

A prior art septic gallery 5 is commonly concrete or formed of plastic resin material and corrugated for strength. This septic gallery 5 is formed in sections that are mated to vary the effective length of the leach field. Sometimes multiple septic galleries 5 are connected to one another to increase the length and capacity of the leaching field, for example a home.

Figure 2A:
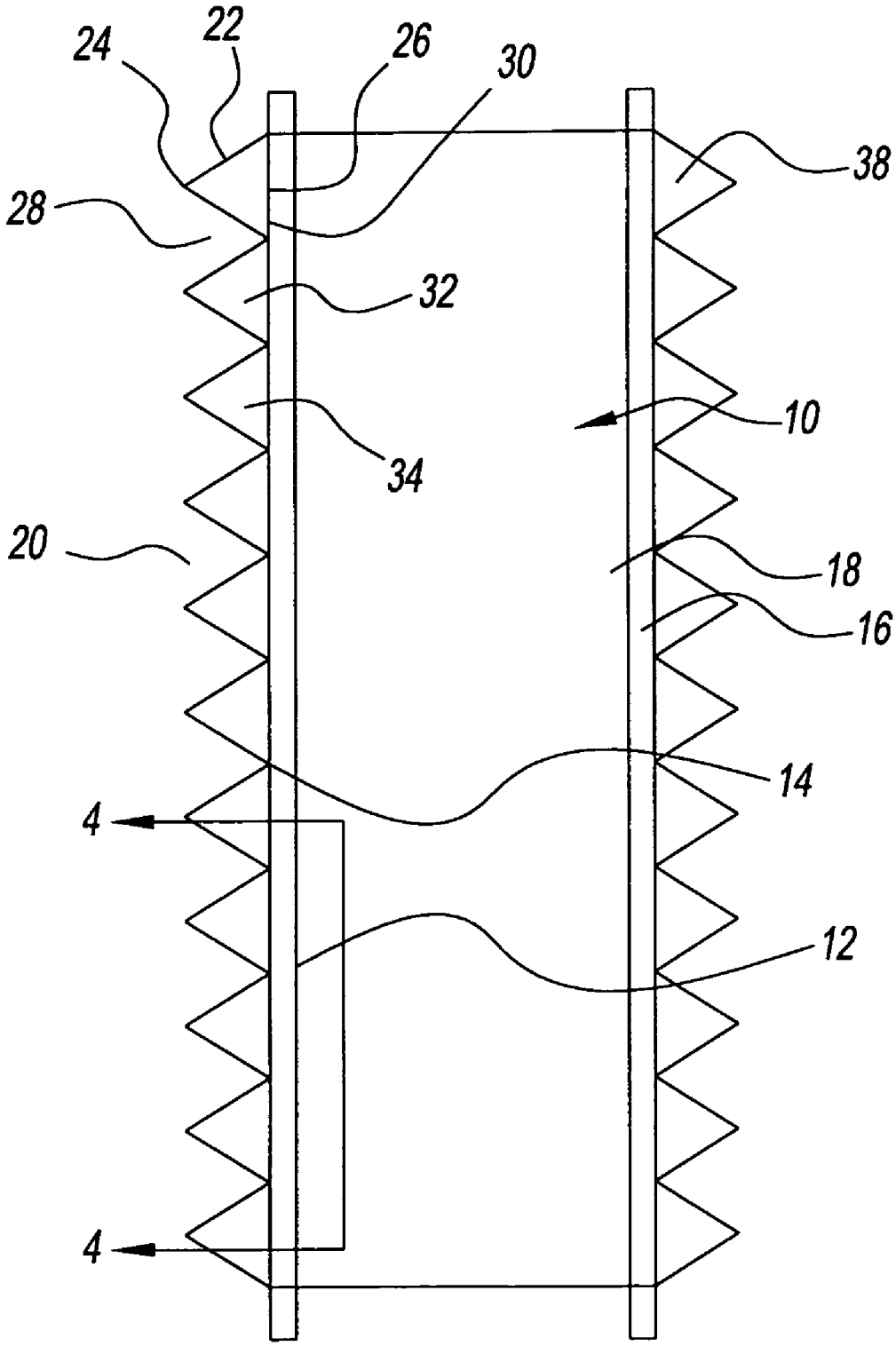
FIGS. 2*a* and 2*b* illustrate a top plan view of the appendages of the present invention connected to a septic gallery.

Referring now to FIG. 2*a*, there is shown the septic gallery 10 of the present invention buried beneath the ground. The septic gallery 10 is preferably connected to an effluent source, and has a first conduit 12 or pipe that is connected to a septic tank or pump chamber. In one embodiment, the septic gallery 10 has a four foot width although galleries can be provided in a variety of standard and/or conventional sizes to accommodate homes and or properties of differing sizes. The septic gallery 10 preferably has a first conduit 12 on a first side 14 of the gallery, and a second conduit 16 on a second side 18 of the gallery. The conduit or conduits can also attach to the gallery. The effluent is in a liquid form and preferably enters the gallery 10 from the first conduit 12 and the second conduit 16 to fill the gallery over time to capacity. Capacity is the number of gallons of effluent and depends on the size of the residence or waste source above ground. After a period of time, prior art galleries becomes full with liquid effluent, and must be replaced.

What is desirable is a device that may increase a capacity of the septic gallery while liquid effluent is not stored therein. Instead, the liquid effluent is diffused to the surrounding environment to percolate through ground for filtering thereof. Most preferably, the present invention achieves this need in an unexpected manner.

The gallery 10 has a first appendage 20 on the first lateral side 14 of the gallery 10. Preferably, the first appendage 20 contacts the ground or sand in the ground contacting side, and also communicates with the first conduit 12 on the first side 14 of the gallery opposite the ground contacting side. The surrounding earth or sand presses appendage 20 to gallery 10. Alternatively, the appendage 20 and the gallery 10 may be formed as one integrated structure or as separate discrete pieces. The first appendage 20, in one embodiment, may be permanently connected to the septic gallery 10 by a connector. Alternatively, the first appendage 20 may be a modular member that is removably connected to the septic gallery 10, for easier replacement thereof or easier addition to the gallery for enhanced septic capability.

Preferably, the first appendage 20 has a number of shaped members to permit enhanced diffusion of the effluent into the ground. The first appendage 20 has any acceptable shape to permit diffusion into the ground from the gallery 10 in a rapid manner. Preferably, the first appendage 20 has a number of three-sided or triangular shaped members generally represented by reference numeral 22 with each having an apex 24 and a base portion 26. The three-sided members could have a rounded tip. The triangular shaped members 22 collectively preferably form a baffle. Each member 22 is preferably a triangular member having two equal sides to form a substantially isosceles triangle. However, each member 22 can be a substantially equilateral triangle in which each angle includes approximately 60 degrees. Still further, each member 22 may be any three-sided member. Each member 22 is made from a material capable of withstanding the environment of the septic tank and gallery, such as, for example, a plastic resin material that would include resilient thermoplastic, polycarbonate, polyvinyl chloride (PVC), achrilonitride-butadiene-styrene (ABS), polyurethane, or acrylic resin.

In one non-limiting embodiment, the base portion 26 has a width of about one foot. A diffusion space 28 is formed between a first triangular member 30 and a second triangular 32 member of the baffle 22. The diffusion space 28 is also triangular shaped and is preferably allowed to fill in with an acceptable ground contacting material such as sand, gravel, or any combination thereof, for diffusion. Likewise, a second diffusion space 28 is formed between the second triangular member 32 and a third triangular member 34. This structure continues along the length of the septic gallery 10. A similar configuration is possible for the trapezoidal shaped appendages, in which successive trapezoidal shaped appendages have a trapezoidal or triangular space therebetween.

Figure 3:
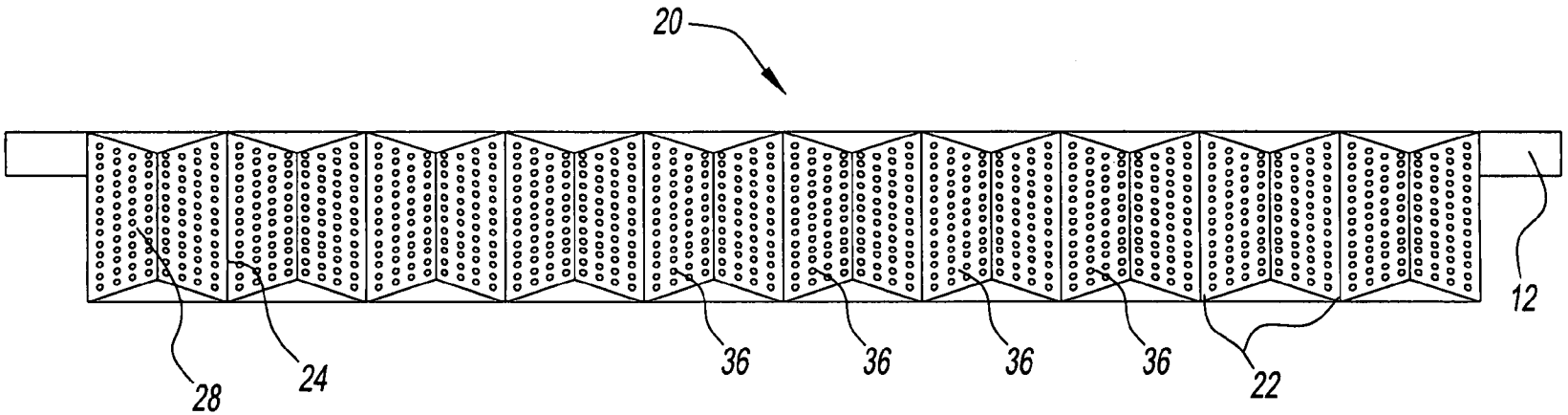
FIG. 3 illustrates a front view of the appendage for the septic gallery.

Referring to FIG. 3, there is shown a frontal view of the baffle with the diffusion spaces 28. The baffle 22 has a number of apertures 36 thereon. The liquid effluent preferably traverses through the apertures 36 and then diffuses into the soil, sand, gravel, or ground. The baffle 22 preferably increases a surface area of the lateral side of the first appendage 20 of the septic gallery 10 to allow an increased amount of liquid effluent to escape from the first appendage, and traverse through the apertures and for diffusion to the sand, or ground.

Figure 4:
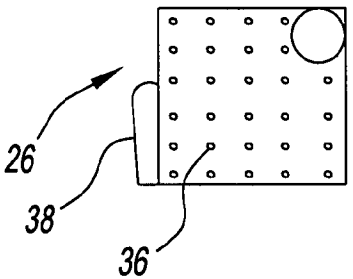
FIG. 4 illustrates a cross-sectional view of the septic gallery taken along line 3-3 of the gallery of FIG. 1.

Referring to FIG. 4, there is shown a cross sectional view of the first appendage 20 along line 4-4 of FIG. 2*a*. The base portion 26 of each triangular member of the baffle 22 has the apertures 36 in a configuration.

Figure 2B:
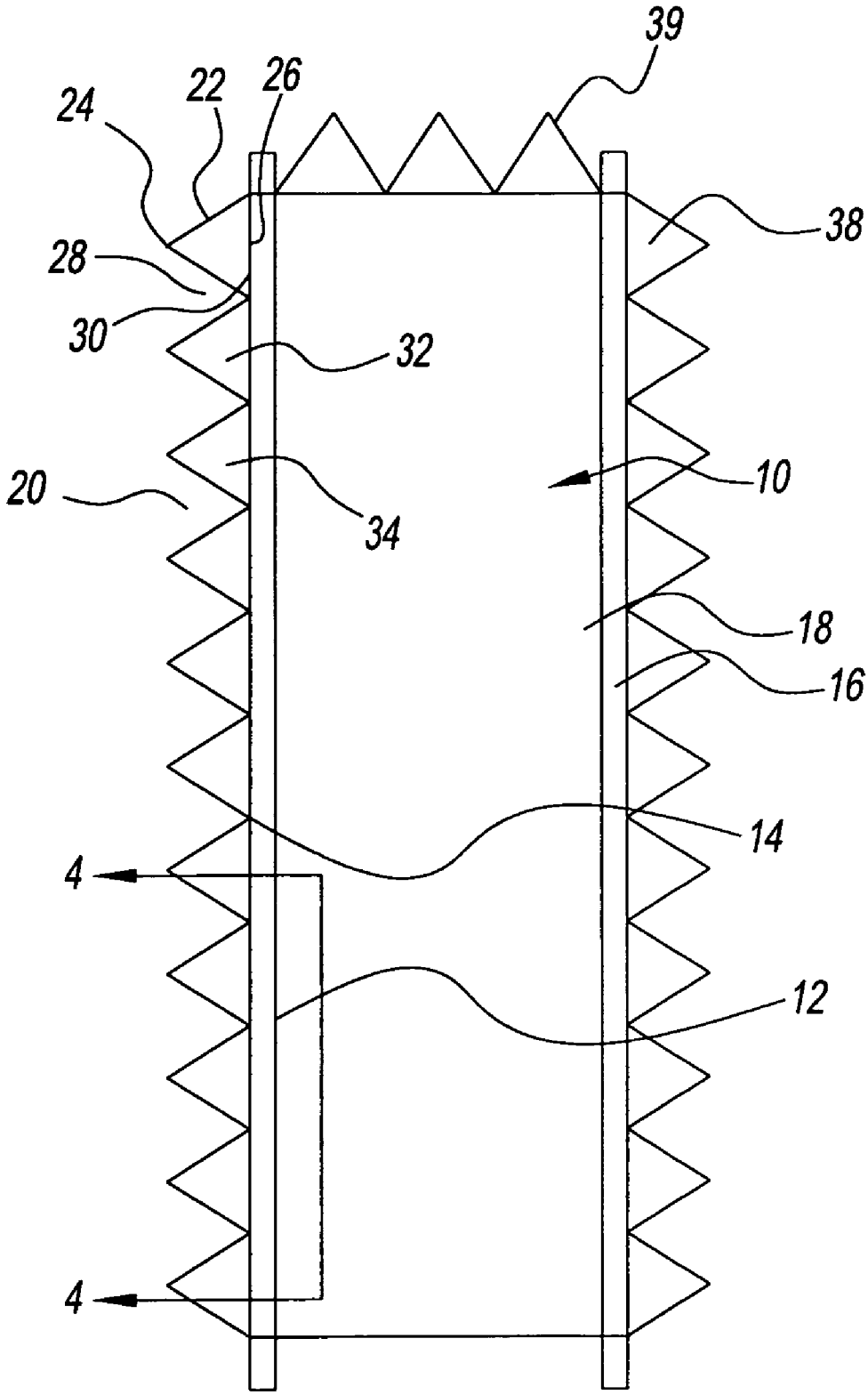

Preferably, the septic gallery 10 also has a second appendage 38 located on a second side 16 of the septic gallery 10 as shown in FIG. 1. Additionally, the first and the second appendages 20, 38 may form modular members to retrofit to an existing septic gallery 10 to increase a capacity thereof. Appendages 20 and 38 can be fabricated to accommodate existing and new galleries. Spaces between first and second appendages 20 and 38, respectively, can be filled with mason sand or any such material that can accept the fluid. Referring to FIG. 2*b*. gallery 10 could also have an additional third appendage 39 affixed to an end thereof to provide diffusion capability on three sides.

Figure 5:
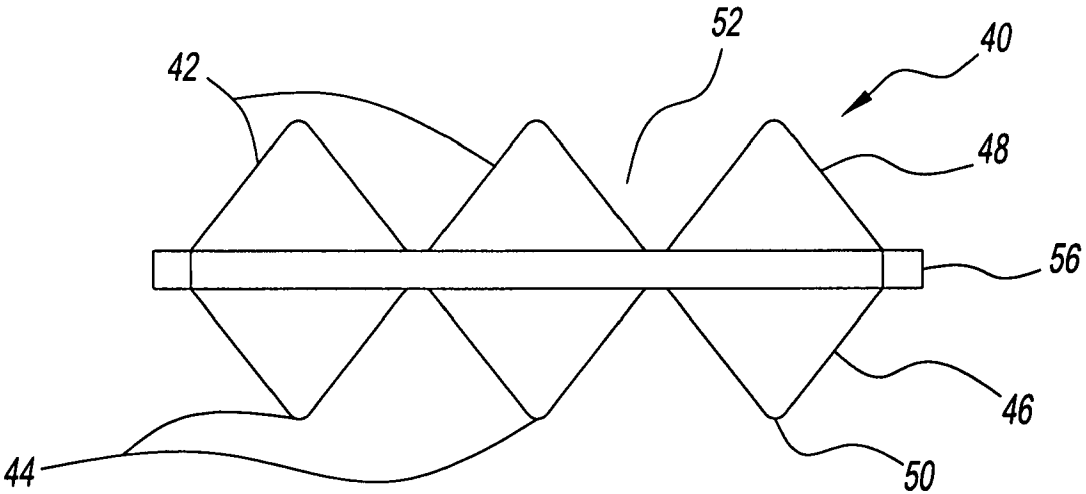
FIG. 5 illustrates a top plan view of two appendages of the present invention connected to each other without a septic gallery.
Figure 6:
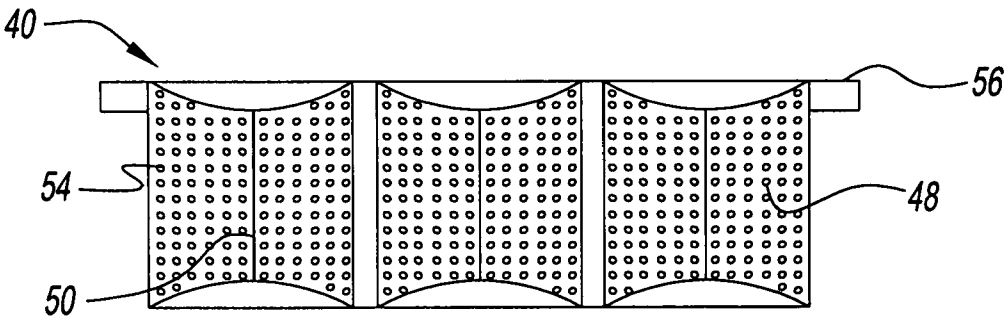
FIG. 6 illustrates a front view of the appendages of FIG. 5 of the present invention.

Referring to FIGS. 5 and 6, a second embodiment of an appendage system 40 of the present invention, is shown. System 40 has two appendages 42 and 44 that are abutting each other. Each appendage 42 and 44 can have any number of triangular elements 46 to form a baffle 48. Each baffle 48 has numerous apertures 54 to allow for passage of effluent into leaching field. Triangular elements 46 can have rounded tips 50 to further increase the surface area of diffusion of liquid into the soil 52 in the leaching field. Baffle 48 preferably increases a surface area of the lateral side of the first appendage 42 and 44 to allow an increased amount of liquid effluent to escape from the appendages and channel 56, and traverse through the apertures and for diffusion to the sand, or ground.

Figure 7:
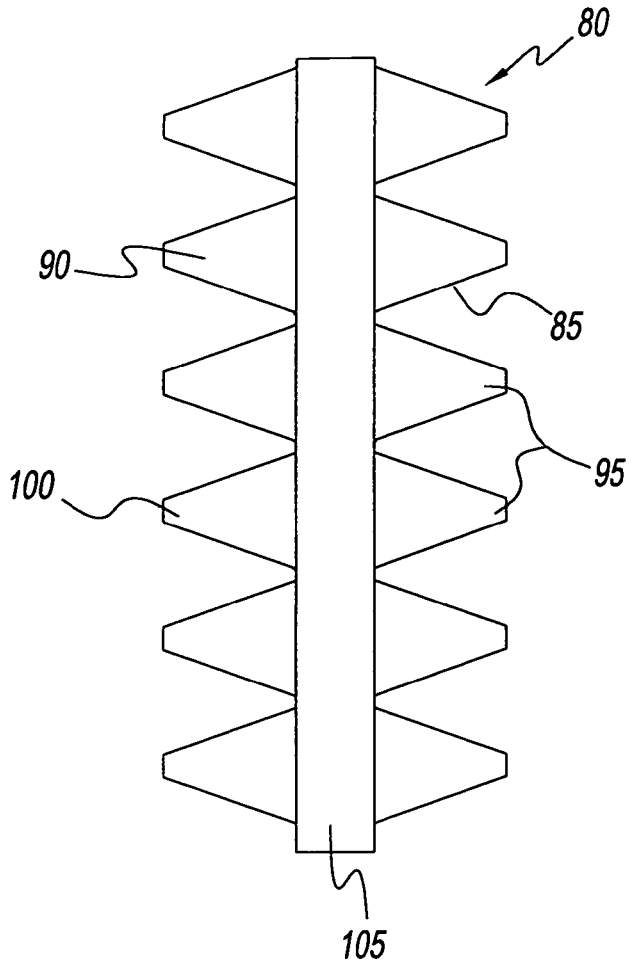
FIG. 7 illustrates a top view of the appendages of a second embodiment of the present invention having trapezoidal appendages on opposite sides of a gallery.
Figure 8:
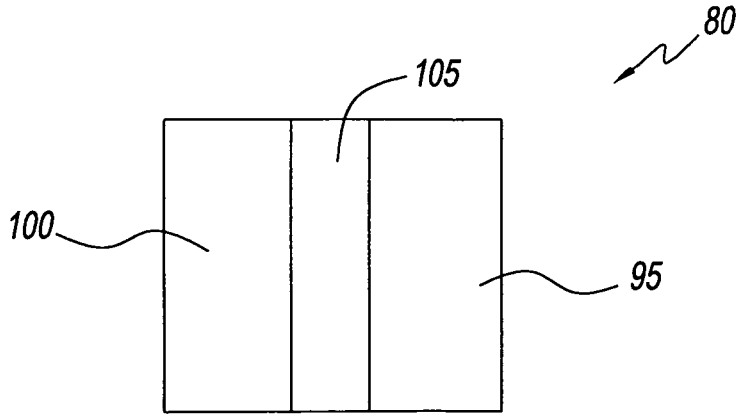
FIG. 8 illustrates a top view of the third embodiment of the present invention having a unitary construction and trapezoidal appendages and a central conduit/pipe.

In a third embodiment of the present invention shown in FIGS. 7 and 8, septic system 80 has an entirely unitary structure. System 80 has a first baffle 85 and a second baffle 90. Each baffle has a plurality of trapezoidal appendages 95 and 100, respectively, integrally connected thereto to form a unitary trapezoidal configuration. A center channel 105 or conduit extends through the center of baffle 85 and facilitates the flow of effluent from source and through appendages 95 and 100. Channel 105 has a relatively small diameter relative to the dimensions of the appendages 95, to maintain a small footprint of the entire system without compromising dispersion capability. Channel 105 has a length of approximately from 6 feet to approximately 8 feet long. The height and width are approximately 1 foot to 4 feet depending upon the required capacity of the system. Appendages 95 and 100 are approximately 1 feet to 3 feet in length away from channel 105. The overall with of conduit 105 together with appendages 95 and 100 is preferable from 4 feet to 6 feet. The unitary configuration permits a high capacity septic system with a small footprint thus minimizing the amount of land required for placement beneath or near a residence or building.

Figure 9:
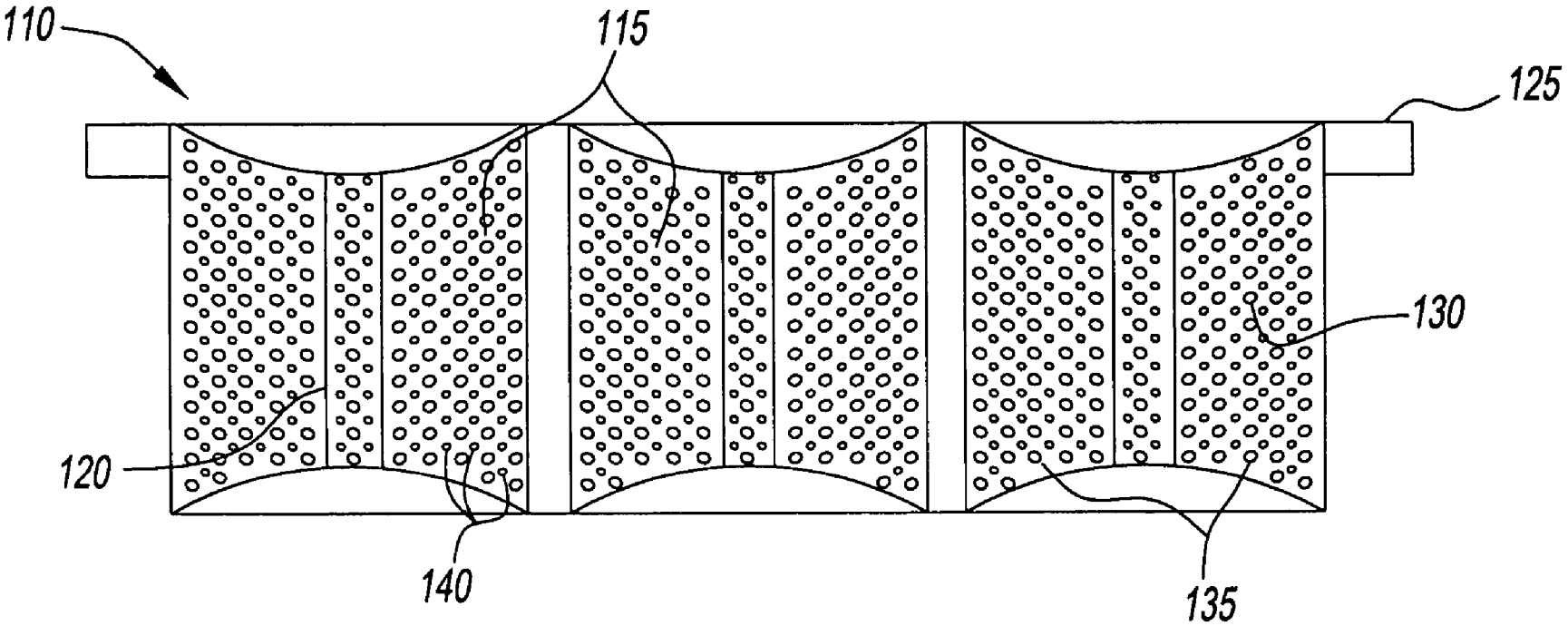
FIG. 9 illustrates a top front view of the third embodiment of the present invention of FIG. 8.
Figure 10:
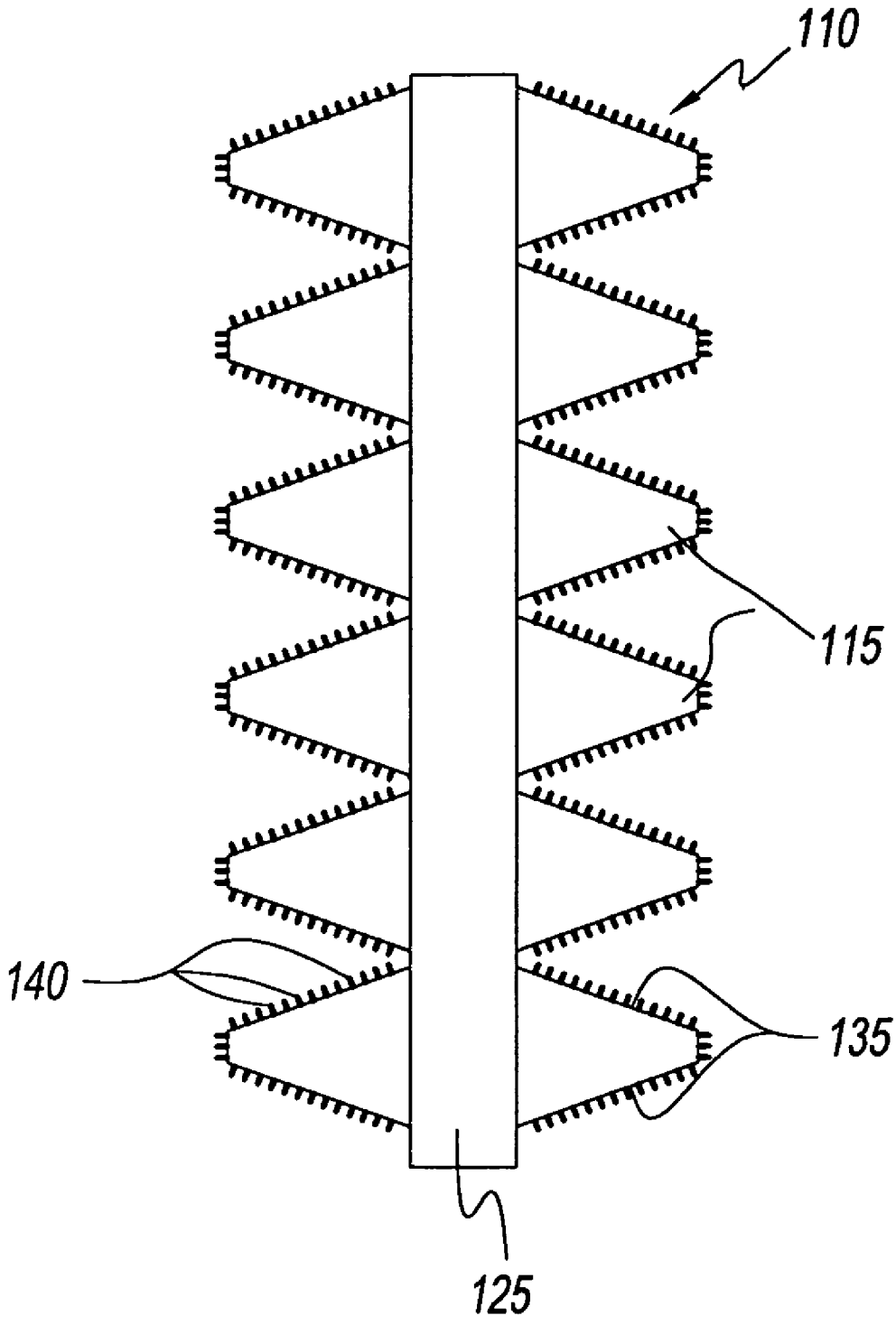
FIG. 10 illustrates a side view of the fourth embodiment of the present invention having a plurality of protuberances on the surface baffle appendages.

In an fourth embodiment, a septic system 110 is shown in FIGS. 9 and 10. Septic system 110 also has a plurality of appendages 115 that each have a flattened tip to form a polygon such as a trapezoid, instead of an apex as shown in the previous embodiment. The plurality of trapezoidal shaped appendages 115 collectively form a baffle 120. Appendages 115 are on opposite sides of gallery 125 to effect the diffusion of effluent. Appendages 115 each have a pattern of holes 130 therethrough to expedite the passage of the effluent into the surrounding soil. In addition to a pattern of holes 130 extending through the appendages surfaces 135, surface 135 also have a plurality of protuberances 140 thereon. Protuberances 140 maintain a distance between the appendage faces 135 and any filter material placed over appendages faces 135. The protuberances 140 extend in a direction perpendicular to the surface of the appendage surfaces 135. The dimensions of protuberances 140 vary from 0.25 inches of 0.50 inches. The dimensions of each appendage 115 vary and can be from one foot to two feet long. The width of each appendage at its base can be approximately 4 inches and taper to approximately 3 inches or any other easily manufactured dimension. Similarly, the length of baffle 120 can vary to meet the necessary septic system capacity. While the present embodiment shows a trapezoid, the appendages could also have a horse shoe shape, triangular shape, or any other shaped configuration that would permit effluent diffusion.

Further, the height of baffle 120 is preferably maximized for more efficient diffusing of effluent. By having a higher baffle 120 in comparison to a longer galley 125 and baffle arrangement, more of the effluent can be diffused through the baffle 120 because more of the effluent is exposed to the contents of the gallery 125. A higher baffle 120 also allows the footprint of septic system 110 to be smaller. While protuberance 140 are shown on appendage faces 135, protuberances could also project from the surface of appendages 20, 65, 85 and 90.

Figure 11:
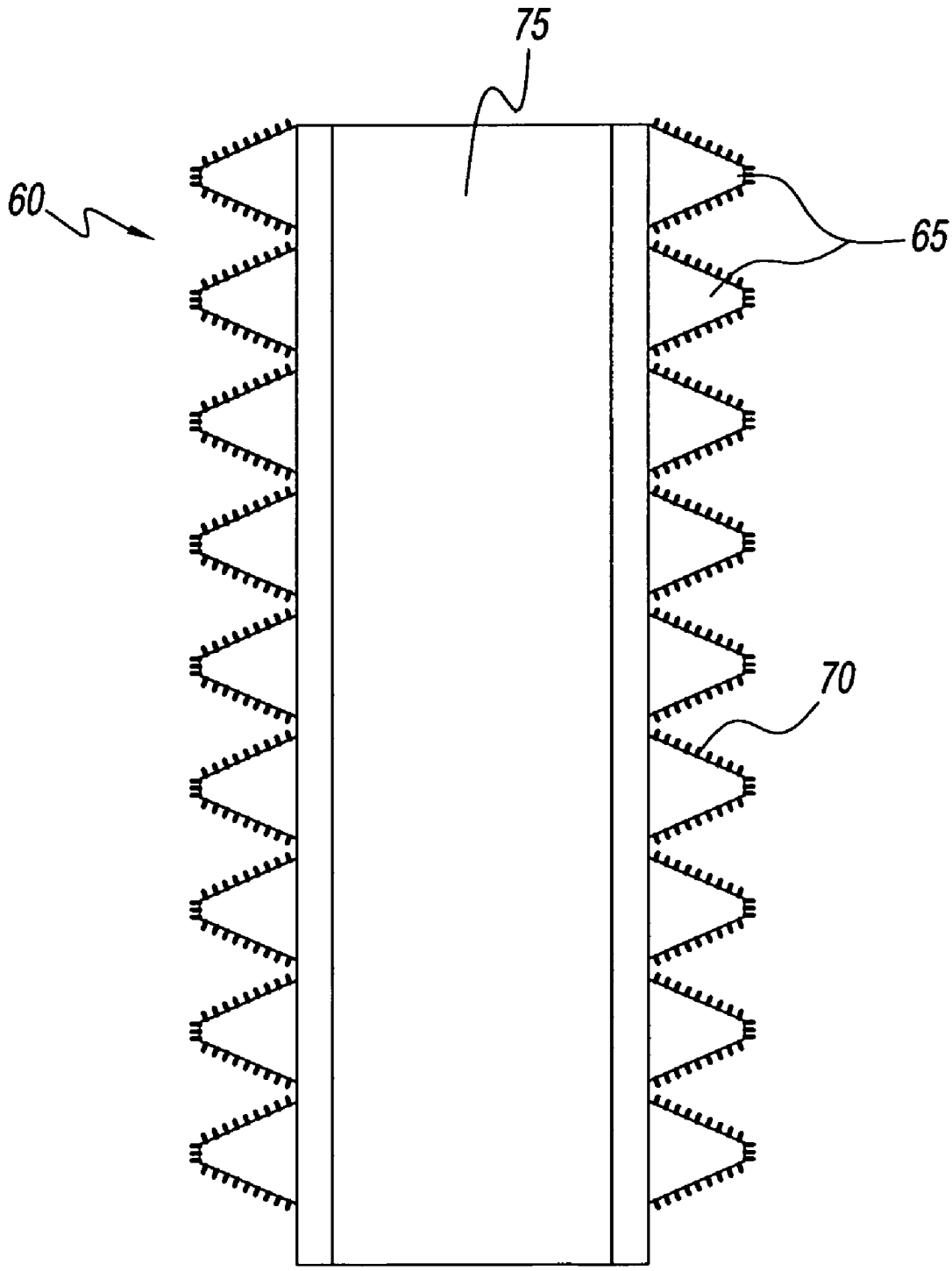
FIG. 11 illustrates a top view of the fourth embodiment of the present invention of FIG. 10.

In an alternative embodiment, a septic system 60 is shown in FIG. 11. Septic system 60 has a relatively broad gallery compared to the conduit 125 of FIG. 10. Septic system 60 has a plurality of appendages 65 that each have a flattened tip to form a trapezoid, instead of an apex as shown in the previous embodiment. The plurality of trapezoidal shaped appendages 65 collectively form a baffle 70. Appendages 65 are on opposite sides of gallery 75 to effect the diffusion of effluent. Appendages 65 each have a pattern of holes therethrough to expedite the passage of the effluent into the surrounding soil. The dimensions of each appendage vary and can be from one foot to two feet long. The width of each appendage at its bases can be approximately 4 inches and taper to approximately 3 inches. Similarly, the length of baffle 70 can vary to meet the necessary septic system capacity. Protuberances may also be present on the facing surfaces of appendages 65 as shown in FIG. 11.

Figure 12:
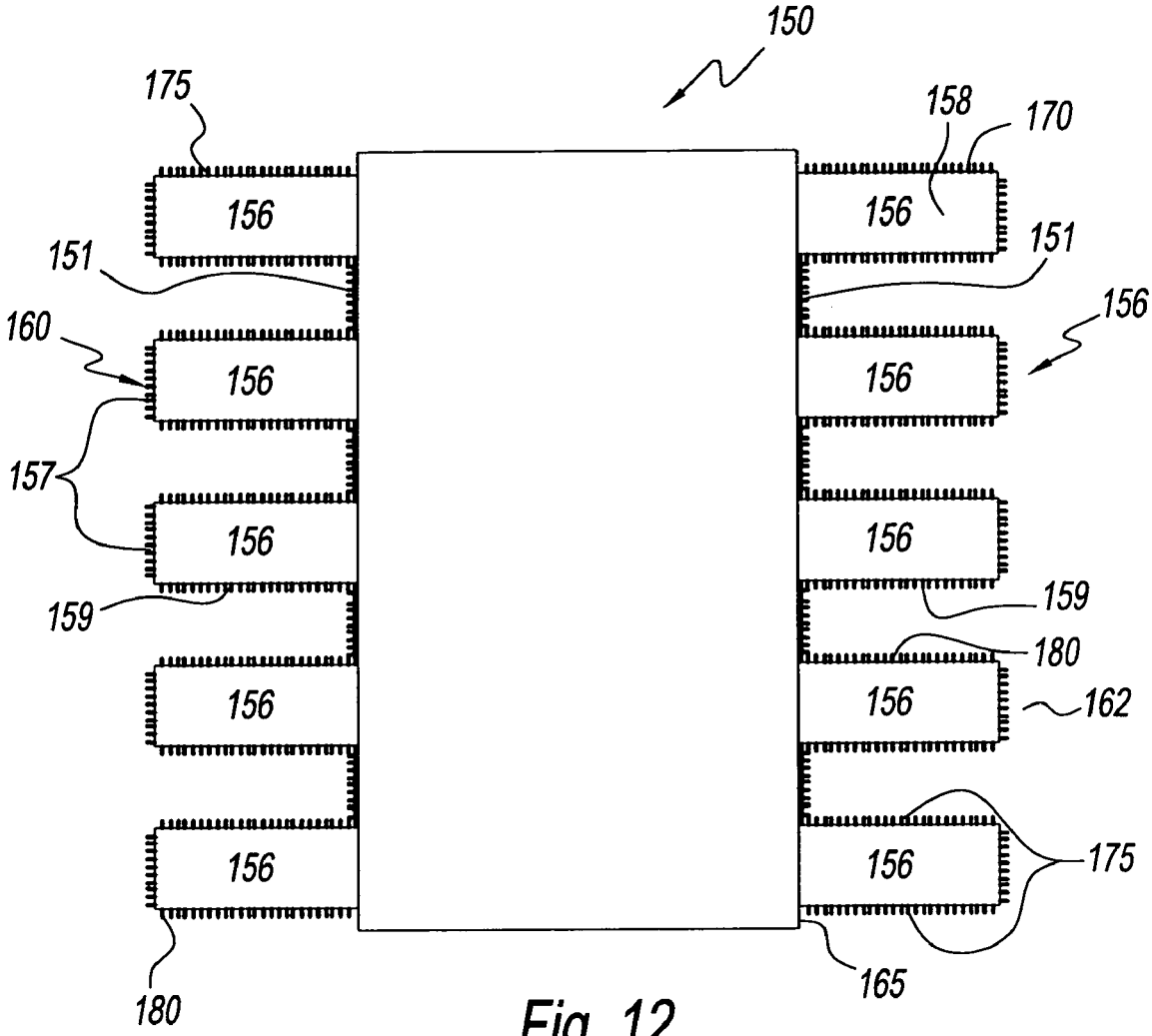
FIG. 12 illustrates a top view of the fifth embodiment of the present invention having a gallery having a plurality of rectangularly shaped appendages and having protuberances thereon.
Figure 13:
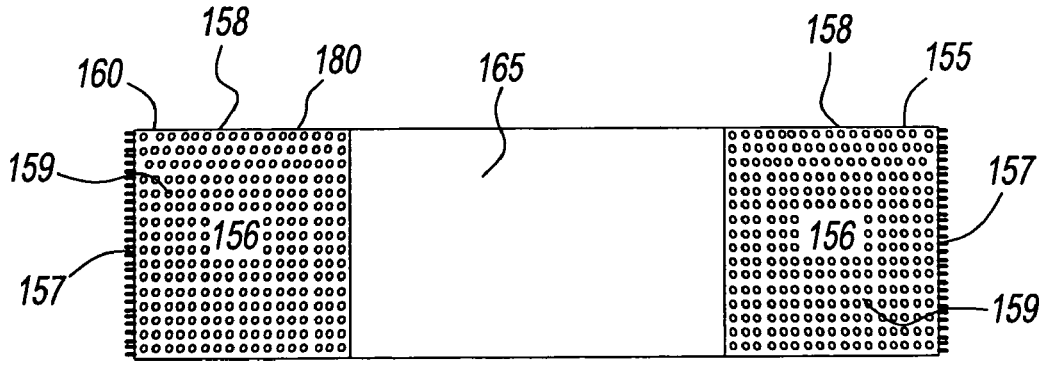
FIG. 13 illustrates a side view of the fifth embodiment of the present invention of FIG. 12.
Figure 14:
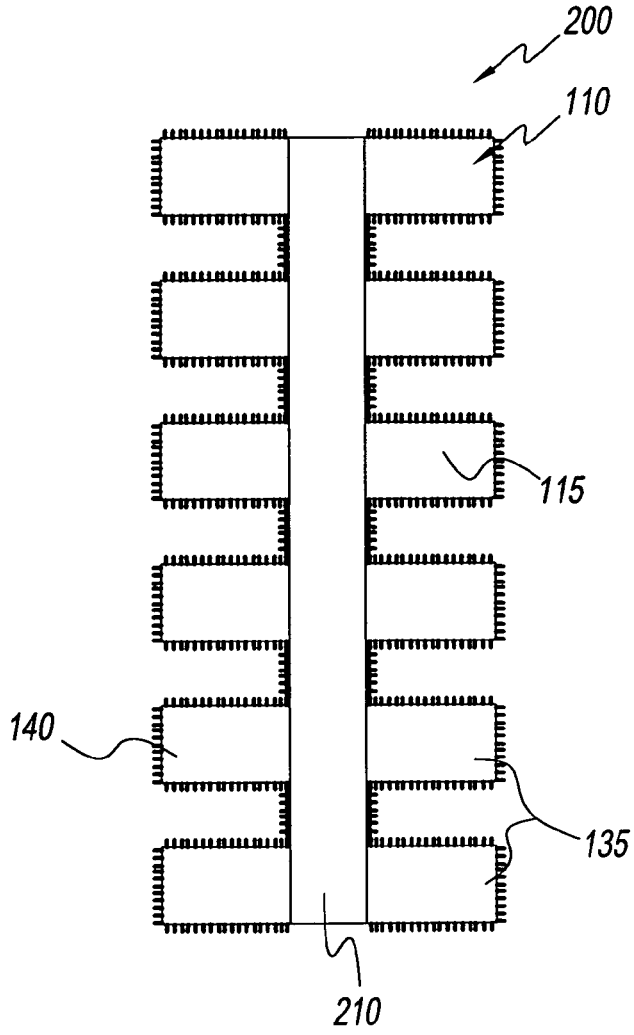
FIG. 14 illustrates a top view of the fifth embodiment of the present invention having a conduit having a plurality of rectangularly shaped appendages each having protuberances thereon.
Figure 15:
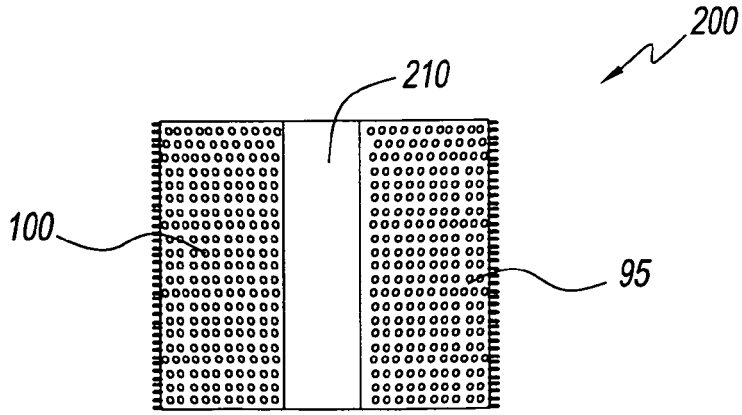
FIG. 15 illustrates a side view of the fifth embodiment of the present invention according to FIG. 14.

In a fifth embodiment, a septic system 150 is shown in FIGS. 12 to 15. Septic system 150 also has a first appendage 155 and a second appendage 160. Each appendage 155, 160 has a plurality of rectangular appendage members 156 that collectively form a baffle. Appendages 155 and 160 are on opposite sides of gallery 165 to effect the diffusion of effluent. While FIGS. 12 and 13 show a gallery 165, a conduit or channel 210 can also be used as shown in FIGS. 14 and 15. Members 156 each have a surface 175 and a pattern of holes 170 extending therethrough on the vertical walls to expedite the passage of the effluent into the surrounding soil. In addition to a pattern of holes 170 therethrough, appendage surface 175 also has a plurality of protuberances 180 thereon. Protuberances 180 maintain a distance between surface 175 and any filter material placed over appendage surface 175. Protuberances 180 are also located on the perimeter of gallery 165. Each member 156 is connected by a connector member 151 that also has a pattern of holes therethrough 170 and protuberances 180 thereon.

In a preferred embodiment of the present invention, appendages 155 and 160 are modular members each having four sides and an open bottom. Appendages have an open side that faces downward and an open back that faces gallery 165. Each vertical side 159 has a length and a height of approximately one foot and 0.25 to 0.5 inches. Appendages 155 and 160 extend in a direction away from gallery 165 and are perpendicular to gallery 165. Appendages 155 have a facing member 157 that is substantially parallel to side of gallery 165. Facing member 157 has a width of approximately from 5.0 inches to 5.5 inches and a height of approximately one foot and a quarter inch to one foot and a half an inch. Vertical sides 159 each connect to an outward facing surface of gallery 165 in a press fit manner. Facing members 157 also connect in a press fit manner to vertical sides 159. Similarly each member 156 has a top covering member 158 that is connected to each vertical side 159 and facing member 157 in a press fit manner. Top covering member 158 is substantially identical in size to facing member 157. Covering members 158 does not have holes extending therethrough or protuberances 180. Vertical side members 159, facing members 157 and covering member 158 all have a plurality of protuberances 180 that extend over the surfaces thereof. Protuberances 180 extend in a direction perpendicular to the surface vertical side members 159 and facing members 157 of the appendage surfaces 175. The dimensions of protuberances 180 vary from 0.25 inches of 0.50 inches.

By being modular in configuration, members 156 can be pre-assembled before being installed beneath the ground. Additionally, the press-fit configuration permits movement between vertical sides 159, facing members 157 and covering member 158 to limit the possibility of breakage during installation. Further, appendages 155 and 160 can be stacked vertically to increase the diffusion capacity of septic system 150 without impacting the size of the footprint beneath the surface of the ground. Appendages 155 and 160 are made from a material capable of withstanding the environment of the septic tank and gallery, such as, for example, a plastic resin material that would include resilient thermoplastic, polycarbonate, polyvinyl chloride (PVC), achrilonitride-butadiene-styrene (ABS), polyurethane, or acrylic resin.

The length of the overall septic system 150 is variable depending upon the septic system capacity needs of the residential or commercial property that is being serviced. The length of each septic system 150 is approximately six feet to eight feet. The height of each appendage 155 and 160 can be from approximately one foot to approximately four feet. This height represents a series of stacked appendages.

Further, the height of appendages 155, 160 are preferably maximized for more efficient diffusing of effluent. By having a higher appendage 155, 160 in comparison to a longer galley 165 and baffle arrangement, more of the effluent can be diffused through the baffle because more of the effluent is exposed to the contents of the gallery 165. A higher baffle also allows the footprint of septic system 150 to be smaller.

Referring to FIGS. 14 and 15, a septic system 200 having a conduit 210, as opposed to a gallery is shown. Septic system 200 contains all features and components of a septic system 150 except that the channel or pipe carrying the effluent is much narrower in width. This narrower width permits a much smaller footprint without sacrificing substantial septic capacity.

Referring to FIGS. 12 through 15, the rectangular configuration of members 156 permits a greater surface area exposure of effluent to surrounding media. Others shapes would potentially reduce the surface area for diffusion into surrounding media. Additionally, connector members 151 provide even spacing and stability between members 156. Connector members 151 are sized to permit effective diffusion of effluent into surrounding media because the space between members 156 is large enough to accommodate diffusion of effluent.

Figure 16:
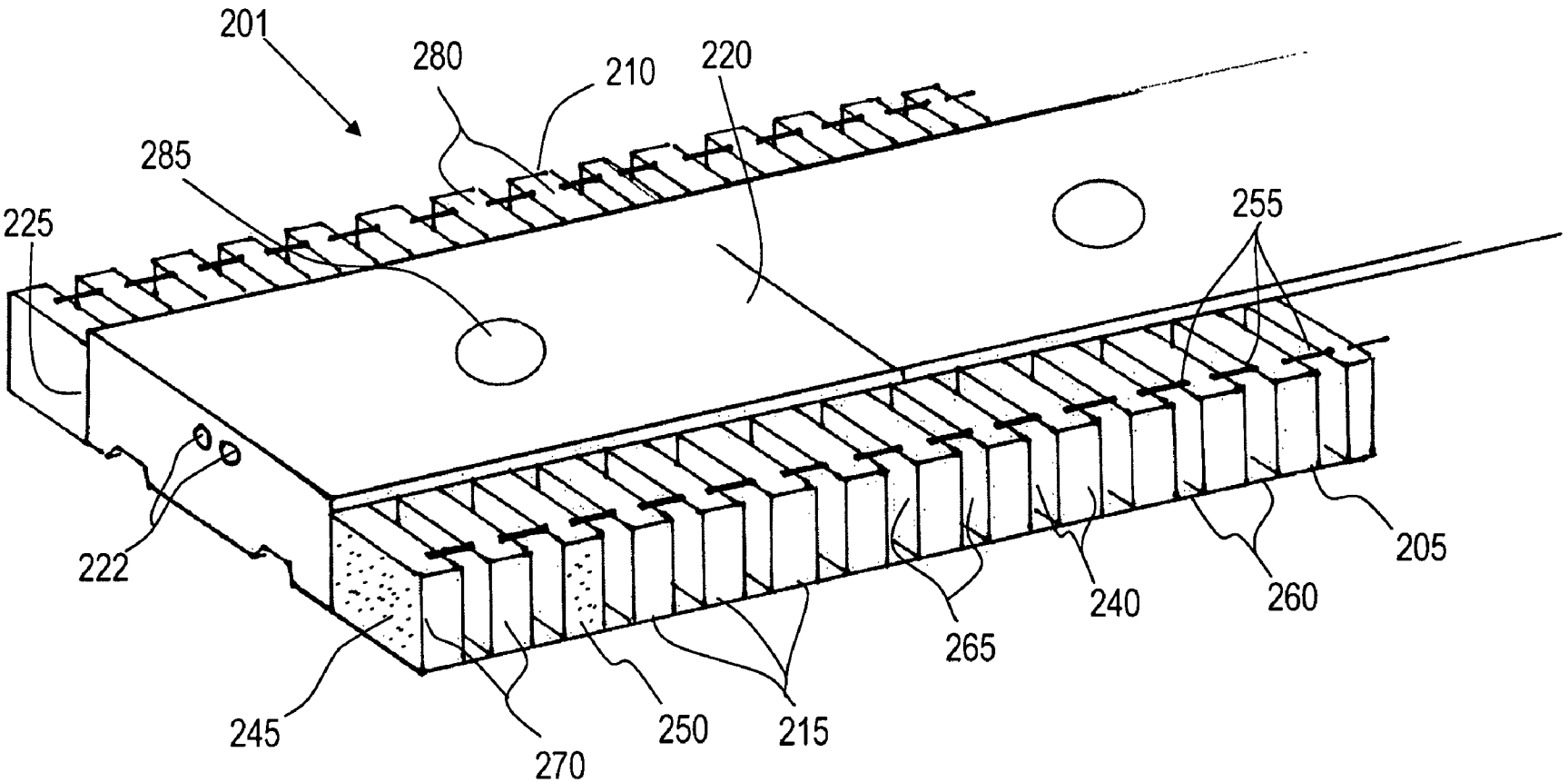
FIG. 16 illustrates a top perspective view of the sixth embodiment of the present invention.
Figure 17:
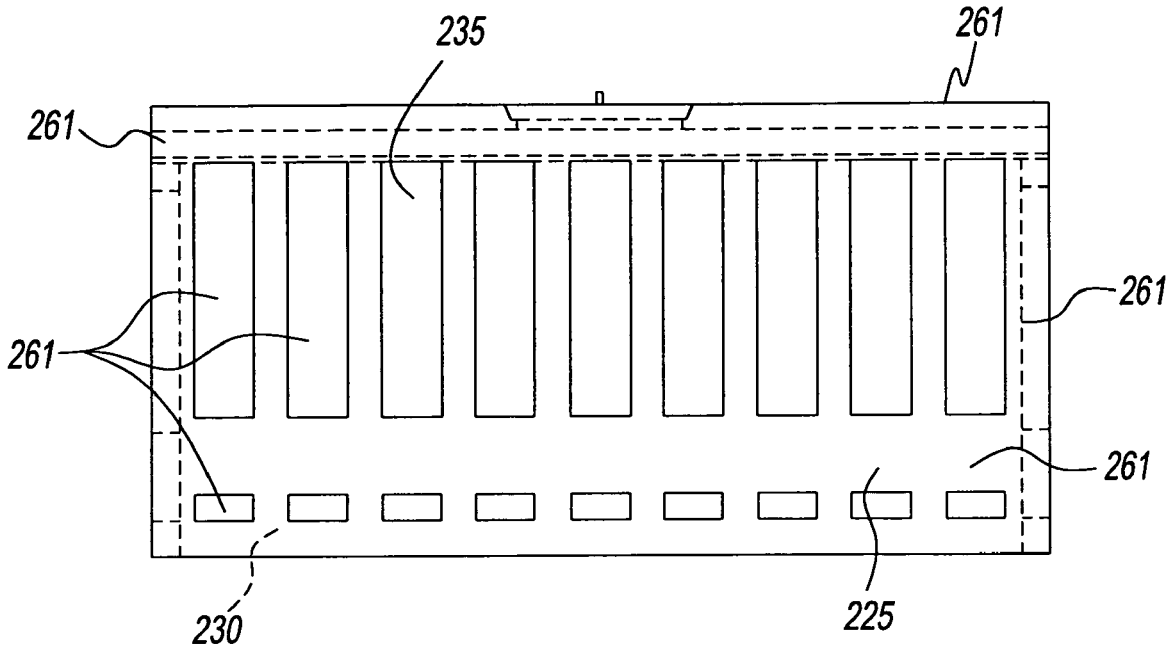
FIG. 17 illustrates a side view of the collection chamber of the sixth embodiment of the present invention.

In a sixth embodiment, a septic system 201 is shown in FIGS. 16 and 17. Septic system 201 also has a first appendage 205 and a second appendage 210. Each appendage 205, 210 has a plurality of preferably rectangular appendage members 215 that collectively form a baffle. Appendages 205 and 210 are on opposite sides of a collection chamber 220 to effect the diffusion of effluent to surrounding soil of leaching field.

While, FIGS. 12 and 13 show a gallery 165, a sixth embodiment discloses a collection housing configured as a collection chamber 220 in greater detail in FIG. 17. Collection chamber 220 is of variable size and contains integral dosing pipes 222 that extend therethrough to transport the effluent into system 201. Significantly, collection chamber 220 has lateral sides 225 and 230 that each has large openings 235 extending therethrough. Large openings 235 on lateral sides 225 and 230 directly face first appendage 205 and second appendage 210, respectively, to allow effluent from pipes 222 direct access to appendages 205, 210. Lateral sides 225 and 230 of collection chamber each has from 2 to 6 openings through a surface thereof for the egress of effluent. The absent portion of lateral side 225 and 230 that are openings 235 are from 30% to 55% of each lateral side. In particular, for the ratio of open portion to surface are from 35%-41%, from 48-54% and from 30% to 35%, for a 12 inch high, a 18 inch high and a 24 inch high lateral side 225, 230. Collection chamber 220 does not have the perforations or the holes or pattern of holes in its lateral sides as the galleries of earlier embodiments. Collection chamber is preferably manufactured from cement.

Appendage members 215 each has a surface 240 and a pattern of holes 245 extending therethrough on the vertical walls to expedite the passage of the effluent into the surrounding soil or leaching field. The appendage members 215 are identical to the appendage members 156 of FIGS. 12 through 15. In addition to a pattern of holes 245 therethrough, appendage surface 240 also has a plurality of protuberances 250 thereon. Protuberances 250 maintain a distance between surface 240 and any filter material placed over appendage surface 240. Filter material is placed over the lateral sides of each appendage member 215 to prevent the entry of soil from the leeching field into system 201. Each member 215 is connected by a strap 255 that ensures proper alignment of appendage member 215 during assembly and prior to installation at the site.

Figure 19:
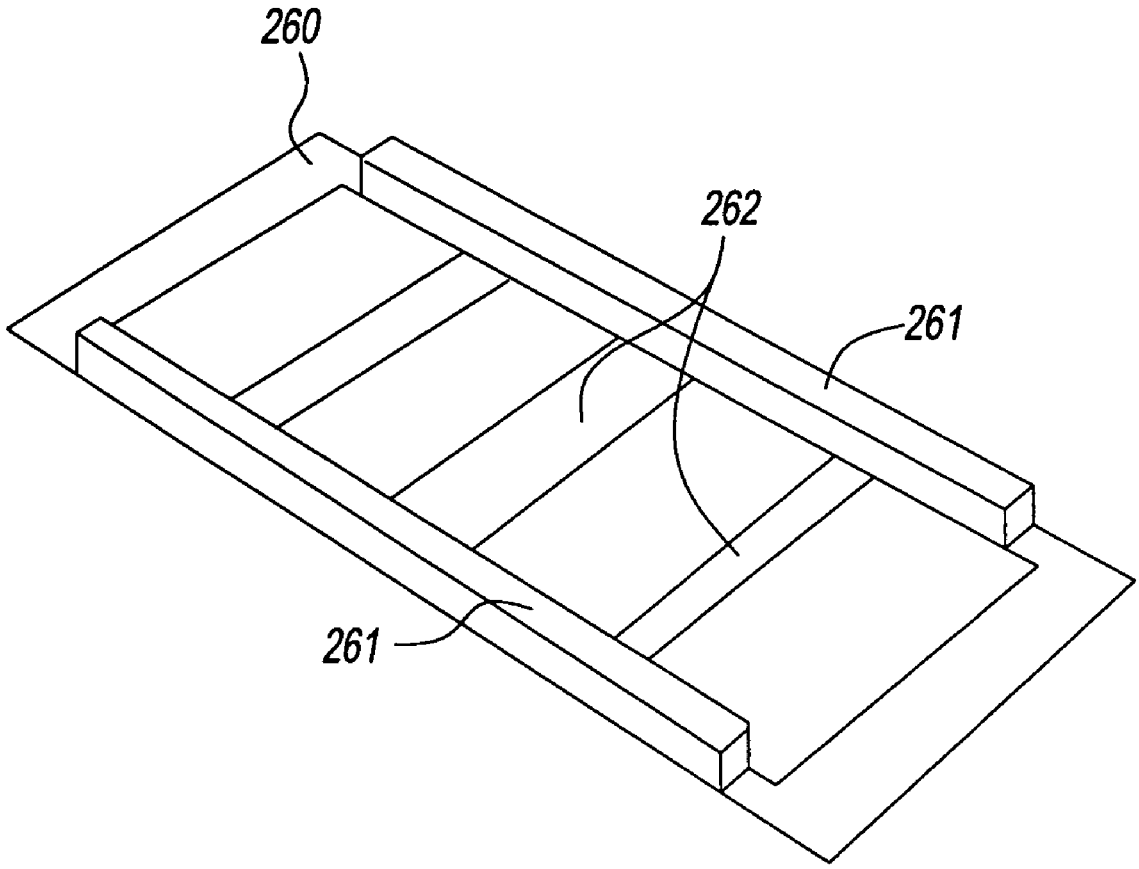
FIG. 19 illustrates a top perspective view of a stabilizing base component of the sixth and seventh embodiments of the present invention.

Referring to FIGS. 16 and 19, that illustrate the sixth and seventh embodiments, base components 260 connect adjacent appendage members 215. Base components 260 prevent appendages 205 and 210, and their appendage members 215 from sinking into surrounding soil in leaching field particularly when soil is saturated with effluent. Base components 260, like straps 255, ensure that proper 25, alignment is maintained between appendages members 215 during assembly and after installation at septic system site. Base components 260 have sides 261 that are secured preferably in a press fit fashion to appendage members 215. Additionally, base components have support surfaces 262 to provide added surface area to septic system 201 to minimize pressure against soil to thereby prevent sinking.

In a preferred embodiment of the present invention, appendage members 215 are modular members each having three outwardly facing sides and a top. Appendage members 215 each have an open back that is adjacent effluent chamber 220. Vertical side 265 of each appendage member 215 is from 12 inches to 48 inches in height, although any convenient height could be used. Appendage members 215 are placed one on top of the other to achieve this 48 inch height. The width of a facing side 270 of each appendage is approximately 6 inches to approximately 6.5 inches, and preferably 6.24 inches. The height of each appendage member 215 is approximately 12 inches to approximately 50 inches high. Appendages 205 and 210 extend in a direction away from effluent chamber 220 and are perpendicular to effluent chamber 220. Vertical sides 265, facing sides 270 and chamber 220 connect to one another in a press fit manner. Similarly each appendage member 215 has a top covering member 280 that is connected to sides 265 and 270 in a press fit manner. Covering members 280 do not have holes extending therethrough or protuberances. Vertical side members 275, facing members 270 all have a plurality of protuberances 180 that extend over the surfaces thereof. Protuberances 180 extend in a direction perpendicular to the surface vertical side members 275 and facing members 270 of the appendage surfaces 175. The dimensions of protuberances 180 vary from 0.25 inches of 0.50 inches.

By being modular in configuration, members 205 and 210 can be pre-assembled before being installed in the ground. Additionally, straps 255 and base components 260 enable easy assembly. Further, the press-fit configuration of adjacent parts permits a degree of relative movement between vertical sides 275, facing members 270, covering members 280 and effluent chamber 220 to limit the possibility of breakage during installation. Further, appendages 205 and 210 can be stacked vertically to increase the diffusion capacity of septic system 201 without impacting the size of the footprint beneath the surface of the ground. Appendages 205 and 210 are made from a material capable of withstanding the environment of the septic tank and gallery, such as, for example, a plastic resin material that would include resilient thermoplastic, polycarbonate, polyvinyl chloride (PVC), achrilonitride-butadiene-styrene (ABS), polyurethane, or acrylic resin. Effluent chamber 220 is preferably made from concrete. Further, effluent chamber 220 has an access or maintenance hole 285 in the top for access, maintenance or inspection.

The length of the overall septic system 200 is variable depending upon the septic system capacity needs of the residential or commercial property that is being serviced. The length of each modular unit of effluent chamber 220 is preferably 8 feet although other lengths could also be used. The height of effluent chamber 220 is approximately one foot to approximately four feet. This height of four feet represents a series of stacked appendages. The width of the effluent chamber 220 is approximately 4 feet.

Figure 18:
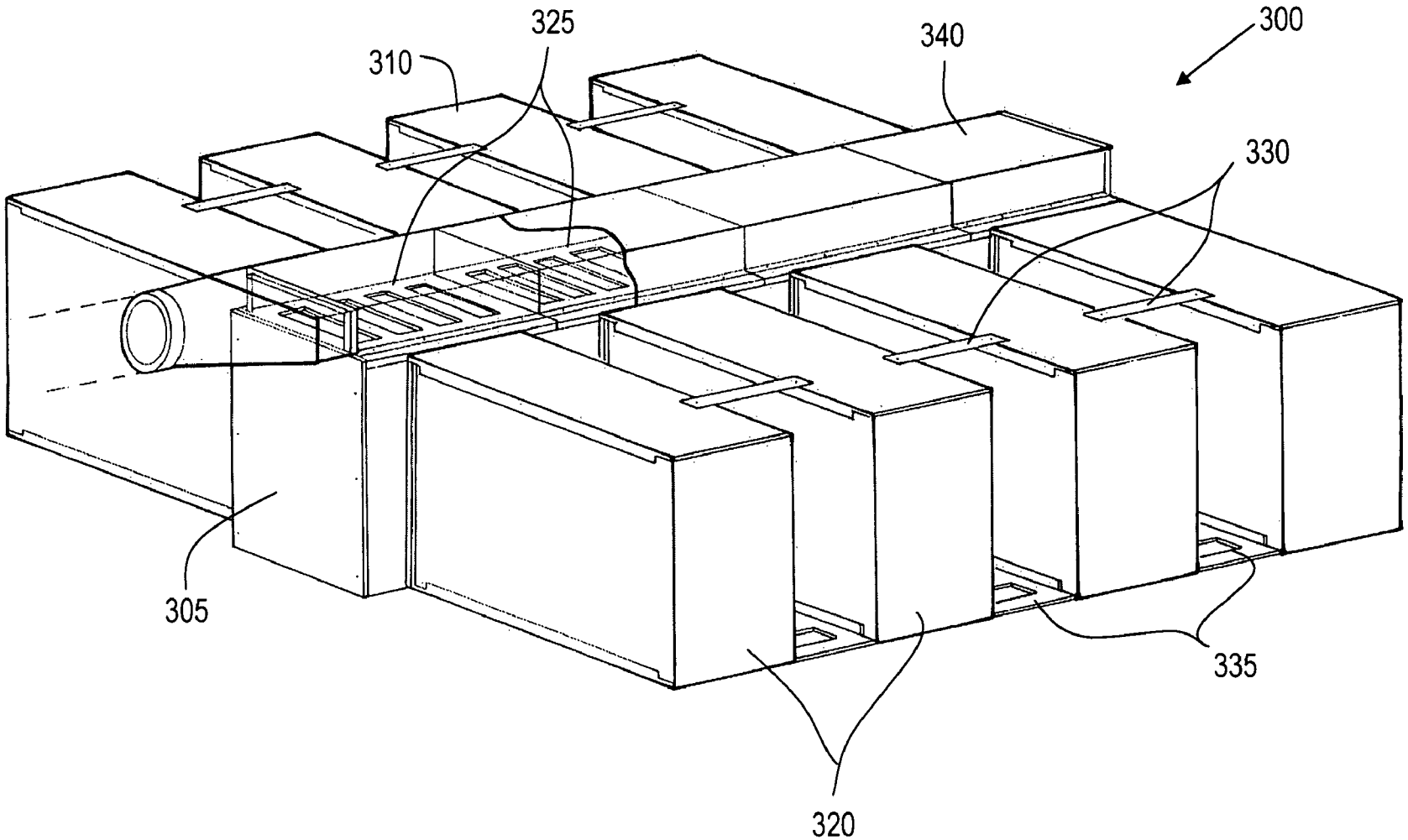
FIG. 18 illustrates a perspective view of the seventh embodiment of the present invention.

In the seventh embodiment of the present invention, shown in FIG. 18, the collection housing is entirely modular in configuration. System 300 has a central collection housing configured as an effluent chamber 305 and first and/or second appendages 310 and 315 on opposing lateral sides of chamber 305. First and second appendages 310 and 315 have appendage members 320 attached thereto to increase the surface area for dispersion of effluent into leaching field. A channel 340 is disposed to direct effluent into chamber 305.

Central effluent chamber 305 of system 300 typically includes a plurality of body segments 325 that are interconnected to form the entire central effluent chamber 305. Each of the plurality of body segments 325 has openings at its top surface to receive effluent from pipe 340. Similarly, opposing sides of each body segment 325 each have openings from which effluent in each body segment 325 can diffuse into appendage members 320. Each of the plurality of body segments 325 of effluent chamber 305 are preferably approximately 10.5 inches in length and are interconnected to provide the necessary septic capacity depending upon the needs of the building that is being serviced. Body segments 325 can be of variable height and width. Body segments vary from 12 inches to 48 inches in height and vary from 8 inches, 16 inches, to 24 inches in width. While these dimensions are preferable, any dimension of body segment can be configured to yield a volume to accommodate the needs of a particular septic capacity.

Central effluent chamber 305 has connected thereto a first appendage 310 and a second appendage 315, like sixth embodiment of the present invention. Each appendage 310, 315 has a plurality of preferably rectangular appendage members 320 that are disposed on opposite sides of effluent chamber 305 to effect the diffusion of effluent therethrough to leaching field surrounding system 300.

Adjacent appendage members 320 are connected by straps 330 to ensure proper alignment during assembly and prior to installation at the site. Additionally, base components 335 connect adjacent appendage members and are identical to the base components of FIG. 19. Base components 335 prevent central effluent chamber 305 and appendage members 320 from sinking into surrounding soil in leeching field particularly when soil is saturated with effluent. Base components 335, like straps 330, ensure that proper alignment is maintained between appendages 320 and effluent chamber 305 during assembly and after installation.

Disposed over the entire top portion of central effluent chamber 300 is a pipe or channel 340. Pipe 340 has an inverted U-shaped configuration. Pipe 340 is approximately two inches in height and approximately 6 inches in width to fit over effluent chamber 305. Pipe 340 is made from a material that is impervious to the effluent and is preferably, nylon, ABS or PVC, although other similar materials could also be used. Disposed over system 300 is a filter fabric to prevent soil from entering effluent chamber and appendages 340.

It should be understood that the foregoing description is only illustrative of the present invention. Various alternatives and modifications can be devised by those skilled in the art without departing from the scope of the present invention. Accordingly, the present invention is intended to embrace all such alternatives, modifications and variances.

What is claimed is:

1. A modular appendage for a septic collection housing having a lateral side with a second area, the modular appendage comprising: a first modular section for connection to the lateral side of the housing, said first modular section having a plurality of apertures therethrough, wherein said first modular section has a first area that is greater than said second area of the housing; said first modular section having a plurality of diffusion members thereon.

2. The modular appendage of claim 1, wherein said first modular section may be stacked horizontally and connected to another second modular section.

3. The modular appendage of claim 1, wherein said first modular section may be stacked vertically and connected to another second modular section.

4. The modular appendage of claim 1, wherein said plurality of diffusion members are a plurality of polygonal shaped members with each of said polygonal shaped members having an distal portion and a base portion opposite said distal portion.

5. The modular appendage of claim 4, wherein each of said plurality of polygonal shaped members has said distal portion opposite said second area of the housing, and wherein said base portion is connected to said second area of said housing.

6. The modular appendage of claim 4, wherein said first modular section is made from a plastic resin material selected from the group consisting of resilient thermoplastic, polycarbonate, polyvinyl chloride (PVC), achrilonitride-butadiene-styrene (ABS), polyurethane and acrylic resin, and any combinations thereof.

7. The modular appendage of claim 4, wherein said first modular section has a plurality of polygonal shaped members including a first polygonal shaped member having a first distal end and a second polygonal shaped member having a second distal end, wherein the first modular section has a space formed between said first distal end and said second distal end, said space being suitable to have earth disposed therein.

8. The modular appendage of claim 7, wherein said earth therein is selected from the group consisting of a filtering medium, sand, dirt, rock, gravel, an organic medium, an inorganic medium, an insulating material, and any compositions thereof.

9. The modular appendage of claim 1, wherein each of said plurality of diffusion members is a rectangle.

10. The modular appendage of claim 1, wherein each of said plurality of diffusion members has a plurality of protuberances thereon.

11. The modular appendage of claim 10, wherein each of said plurality of protuberances has a length of approximately from 0.25 inches to 0.50 inches.

12. A modular appendage for a septic collection housing, said housing having a first lateral side, a second lateral side being opposite said first lateral side and a third side perpendicular to said first side and said second side, the modular appendage comprising: a first modular section for connection to the first lateral side of the septic housing, said first modular section having a plurality of apertures thereon, wherein said first modular section has a plurality of diffusion members, wherein said each of said plurality of diffusion members form a plurality of spaces therebetween; and a second modular section for connection to the second lateral side of the septic housing, said second lateral side being opposite said first lateral side, said second modular section having a plurality of apertures thereon, and wherein said second modular section comprises a second plurality of diffusion members, wherein said second plurality of diffusion members forms a plurality of spaces therebetween.

13. The modular appendage of claim 12, wherein said filtering material is selected from the group consisting of sand, dirt, rocks, gravel, an organic medium, an inorganic medium, an insulating material, and any combinations thereof.

14. The modular appendage of claim 12, further comprising third modular section for connection to said and a third side of the septic housing, perpendicular to said first side and said second side, said third modular section being sized in a complementary manner to the septic housing.

15. The modular appendage of claim 12, wherein said first modular section further comprises an intermediate member connected to said first lateral side of the septic housing, said intermediate member having said plurality of apertures thereon, said plurality of apertures extending into both said plurality of diffusion members and the septic housing.

16. The modular appendage of claim 12, wherein said second modular section further comprises a second intermediate member connected to said second lateral side of the septic housing, said second intermediate member having said plurality of apertures thereon, said plurality of apertures extending into both said plurality of polygonal shaped members and the septic housing.

17. The modular appendage of claim 12, wherein said first modular section is retrofit to the septic housing.

18. The modular appendage of claim 12; wherein second first modular section is retrofit to the septic housing.

19. The modular appendage of claim 12, wherein said diffusion member has a rectangular shape.

20. The modular appendage of claim 12, wherein each of said plurality of protuberances extend in a direction perpendicular to said a surface of each of said plurality of appendages.

21. The modular appendage of claim 12, wherein each of said plurality of protuberances has a length of approximately from 0.25 inches to 0.50 inches.

22. A septic system for a leaching field comprising: a collection housing having a first side and a second side and an interior for transporting an amount of effluent therein, said first side and said second side being parallel; and at least one filtering expansion device having a plurality of apertures for increasing an effective filtering area of said collection housing at said first side; said at least one filtering expansion device being modularly connected to one of said first side or said second side.

23. The septic system of claim 22, wherein said at least one first filtering expansion device comprises a plurality of rectangular shaped members being disposed adjacent to one another, each of said plurality of rectangular shaped members having a distal portion disposed opposite and parallel to one of said first side or said second side.

24. The septic system of claim 23, wherein ones of said plurality of rectangular shaped members are spaced from others of said plurality of rectangular shaped members forming a space therebetween, said space being suitable for a filtering medium to be in said space.

25. The septic system of claim 22, further comprising a second filtering expansion device, said second filtering expansion device being adjacent a surface of said collection housing and opposite said first filtering expansion device.

26. The septic system of claim 22, wherein said collection housing for transporting effluent is disposed between said first filtering expansion device and said second filtering expansion device.

27. The septic system of claim 25, wherein said second filtering expansion device comprises a plurality of rectangular shaped members each having an distal end disposed opposite said second side.

28. The septic system of claim 25, wherein said first surface, said second surface and said first filtering expansion device and said second filtering expansion device are modularly constructed.

29. The septic system of claim 22, further comprising a plurality of protuberances extending in a direction perpendicular to a surface of each of said plurality of appendages.

30. The septic system of claim 29, wherein each of said plurality of protuberances has a length of approximately from 0.25 inches to 0.50 inches.

31. The septic system of claim 22, wherein said first side and said second side of said collection housing each has from 2 to 6 openings through a surface thereof for the egress of effluent.

32. The septic system of claim 31, wherein a ratio of said openings to said surface of said first side and said second side ranges from 30% to 55% of said side.

33. The septic system of claim 23, wherein adjacent ones of said rectangular shaped members are connected by straps.

34. The septic system of claim 23, further comprising a plurality of base components, wherein ones of said plurality of base components are disposed between adjacent rectangular shaped members to disperse the weight of the septic system.

35. The septic system of claim 22, wherein said collection housing comprises a plurality of modular components that are interconnected; wherein each of said plurality of modular components contain openings therein.

36. The septic system of claim 35, further comprising a channel disposed adjacent and in fluid communication with each of said openings in said plurality of modular components.

37. The septic system of claim 35, wherein fluid transported into the septic system from said channel through each of said openings in said plurality of modular components and through said at least one filtering expansion device.

38. The septic system of claim 23, wherein adjacent ones of said rectangular shaped members are connected by straps.

39. The septic system of claim 22, wherein said collection housing is a collection chamber.

40. The septic system of claim 22, wherein said collection housing is an effluent chamber.

* * * * *